US006123086A

United States Patent [19]

Kuglen

[11] Patent Number: 6,123,086

[45] **Date of Patent: *Sep. 26, 2000**

[54] DECORATIVE HAIR ACCESSORY AND METHOD FOR PROVIDING

[76] Inventor: Francesca B. Kuglen, 1933 Davis St., #286, San Leandro, Calif. 94577

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,769

[22] Filed: Oct. 4, 1996

[51] Int. Cl.[7] ..... A45D 8/12

[52] U.S. Cl. ..... 132/275; 132/128

[58] Field of Search ..... 132/128, 273, 132/275, 148, 146, 101, 219; D28/41, 39, 31, 32, 33

[56] References Cited

U.S. PATENT DOCUMENTS

| | | | |
|---|---|---|---|
| D. 183,654 | 10/1958 | Hambric | D86/8 |
| 184,793 | 11/1876 | Morse . | |
| D. 292,030 | 9/1987 | Revson | D28/41 |
| D. 315,226 | 3/1991 | Revson | D28/41 |
| D. 316,161 | 4/1991 | Kuglen | D28/41 |
| D. 334,793 | 4/1993 | Richardson | D28/41 |
| D. 336,544 | 6/1993 | Maturaporn | D28/41 |
| D. 354,153 | 1/1995 | Marrese | D28/41 |
| 715,600 | 12/1902 | Pomeroy | 132/146 X |
| 904,566 | 11/1908 | Schwab . | |
| 1,152,884 | 9/1915 | Damon . | |
| 1,626,433 | 4/1927 | Siner | 132/273 |
| 1,823,361 | 9/1931 | Hudson | 132/128 |
| 2,386,682 | 10/1945 | Heinman . | |
| 2,426,444 | 8/1947 | Flageole . | |
| 2,700,977 | 2/1955 | Neerup | 132/273 |
| 3,099,271 | 7/1963 | Dubelier | 132/46 |
| 3,120,852 | 2/1964 | Sawyer | 132/145 |
| 3,301,266 | 1/1967 | Hoffmann | 132/46 |
| 4,254,783 | 3/1981 | KIm . | |
| 4,522,215 | 6/1985 | Verducci | 132/219 |
| 5,156,171 | 10/1992 | Goodman | 132/200 |
| 5,174,312 | 12/1992 | Adams | 132/273 |
| 5,240,017 | 8/1993 | Terwilliger | 132/145 |
| 5,301,696 | 4/1994 | Revson | 132/273 |
| 5,335,680 | 8/1994 | Moore | 132/276 |
| 5,379,782 | 1/1995 | Tabb | 132/275 |
| 5,494,060 | 2/1996 | Potut | 132/277 |
| 5,622,194 | 4/1997 | Ledda-Vengerder | 132/273 |
| 5,690,128 | 11/1997 | Grimes | 132/275 X |
| 5,727,574 | 3/1998 | Frye | 132/210 |
| 5,732,720 | 3/1998 | Sears | 132/273 X |

FOREIGN PATENT DOCUMENTS

| | | |
|---|---|---|
| 319203 | 11/1902 | France . |
| 319227 | 11/1902 | France . |
| 372085 | 3/1907 | France . |
| 594906 | 9/1925 | France . |
| 205861 | 3/1908 | Germany . |
| 240377 | 10/1925 | United Kingdom . |
| 279268 | 10/1927 | United Kingdom . |
| 315733 | 7/1929 | United Kingdom . |
| 800390 | 8/1958 | United Kingdom . |
| 98/06295 | 2/1998 | WIPO . |

*Primary Examiner*—Jeffrey A. Smith
*Attorney, Agent, or Firm*—Kathleen A. Skinner

[57] ABSTRACT

A decorative hair accessory with a decorative member which has an elastic component and two free ends with an attachment mechanism at each free end to allow the decorative member to form a continuous decorative elastic band or to connect to itself and form a loop on each end. Another embodiment of the decorative hair accessory is a comb with at least one elongated opening disposed longitudinally in the spine to receive one or more removable decorative members. These decorative accessories can be combined to form a variety of hair accessories which have a pair of combs removably attached to a plurality of elastic decorative members.

31 Claims, 4 Drawing Sheets

DECORATIVE HAIR ACCESSORY AND METHOD FOR PROVIDING

BACKGROUND OF THE INVENTION

1. Field of the Invention

The present invention relates to decorative hair accessories for securing a person's hair in place with different decorative effects and the method of assembling and using the same.

2. Description of the Related Art

Numerous hair devices have been developed over the years to assist women in creating desirable hair arrangements. Devices which secure the hair in place and which are also decorative are particularly desirable. Combs have been used to hold the hair in place on the head, but for many women, especially those with hair which is quite fme or thin, combs are frequently unsatisfactory because they slide out with movement of the head. Women with quite thick hair also have difficulties because many hair accessories break when used with a large volume of hair. One very successful hair accessory in this field, which is illustrated in U.S. Pat. No. Des. 316,161 and is known as an Accordian® hair comb, provided a solution to these problems by employing two combs with a number of elastic bands permanently attached to their spines. The combs of this device are turned under the elastic bands and aligned with their teeth facing each other. When the combs are slid under the hair to a desired location, the tension in the elastic bands causes the combs to be continuously pulled toward each other, locking the combs in place in the hair and preventing them from sliding out of the hair. The elastic bands could also be expanded to secure the device in very voluminous hair. The elastic bands of this device have been covered with tubular fabric or attached to the underside of ribbons or the like for decorative effect. These Accordian hair decorations have been manufactured with two or three bands, in a variety of sizes, and in different fabrics and materials covering the bands, for different fashion effects.

Another widely used hair device is a ponytail holder, which has evolved from a relatively simple elastic band such as that shown in U.S. Pat. No. 3,301,266 to widely decorated elastic bands, such as U.S. Pat. Nos. 5,301,696; 5,156,171; Des. 354,153; Des. 292,030; Des. 336,544, and others.

Despite these many choices, there has been a need for even more versatility in decorative hair devices, particularly those using connected combs, so that the user can create different effects, such as mixing different color bands on the same set of combs, or crossing the bands over each other, or attaching a single band to each end of one comb with the bands looping over each other in the middle. Accordingly, the present invention solves that need by providing interchangeable decorative bands which can be removably attached to specially adapted combs. Each decorative elastic band can also be attached to itself, rather than to a pair of combs and used individually as a decorated elastic ponytail holder. Moreover, the combs can be decorated with other removable items, such as ribbons or flowers, and also used independently of the combination. This invention thus provides a number of decorative accessories which can be used as individual items, but which are also designed to be removably used together in arrangements uniquely designed by the user. This invention thus provides several multipurpose accessories and, as a result, dramatically increases the options and versatility of these accessories for the user and it allows the user to express her own creativity in the assembly and application of the accessories.

SUMMARY OF THE INVENTION

The present invention is a decorative hair accessory, of which one embodiment is a decorative member with an elastic component and two free ends. At each free end of the decorative member is an attachment mechanism which is removably attachable to the attachment mechanism at the other free end, so that if one end of a decorative member is attached to its other end, a continuous decorative elastic band is formed. The attachment mechanism includes first and second attachment members, such as self-attaching tabs. Each free end of the decorative member is also shaped to fit through an elongated opening in the spine of a hair comb and the attachment mechanism may then form a loop and attach to itself, capturing a portion of the spine of the comb in the loop and removably securing the decorative member to the comb.

Another embodiment of the invention is a comb having a relatively wide spine and a series of teeth extending along one side of the spine in regular alignment. The spine of the comb has one or more elongated openings disposed longitudinally in the spine and sized to receive a removable decorative member. One free end of the decorative member may be inserted into the elongated opening in the spine of the comb and the attachment mechanism of the decorative member will allow the end to be attached to itself around a portion of the spine of the comb. The other free end of that decorative member may be similarly attached to the spine of a second comb proximate an elongated opening in its spine. Similarly, a second decorative member may be attached at each of its free ends to a second elongated opening in each comb, and in some embodiments, a third decorative member can be attached at each of its ends to a third elongated opening in each comb. This embodiment of the invention employing a pair of combs connected by at least one elastic decorative member is used by turning the two combs to the underside of the decorative bands in an alignment which allows the teeth of one comb to face the teeth of the other comb. The first comb can then be slid under the hair, the band(s) can be stretched apart and the second comb can also be slid into the hair. A gathered portion of hair will be captured between the combs and the combs will be pulled toward each other and held in that position by the elastic component of the decorative band(s). The hair accessory can be removed from the hair by stretching the band(s) so that the combs can be pulled out of the hair. The band(s) can be removed from the combs by pulling the attachment members apart and each band can be replaced by a decorative member of another color or fabric, if desired.

Thus, it is an object of this invention to provide a decorative member which can attach to itself, end to end, to form a continuous decorative elastic band for use as a ponytail holder, or which can be removably attached at each end to one of a pair of combs. It is also an object of this invention to provide a hair comb with at least one elongated opening in the spine for receiving decorative objects. It is another object of this invention to provide a hair accessory with restraining combs which are pulled together by removable elastic decorative bands which can be attached to the combs in a variety of combinations. It is also an important advantage of this invention to provide different embodiments of the invention, which are versatile and can be selected and used in different ways to create a variety of unique hair accessories by the user.

Other objects and advantages of the invention will become apparent from the description of the preferred embodiments and the drawings described hereafter.

DESCRIPTION OF THE PREFERRED EMBODIMENTS

Figure 1:
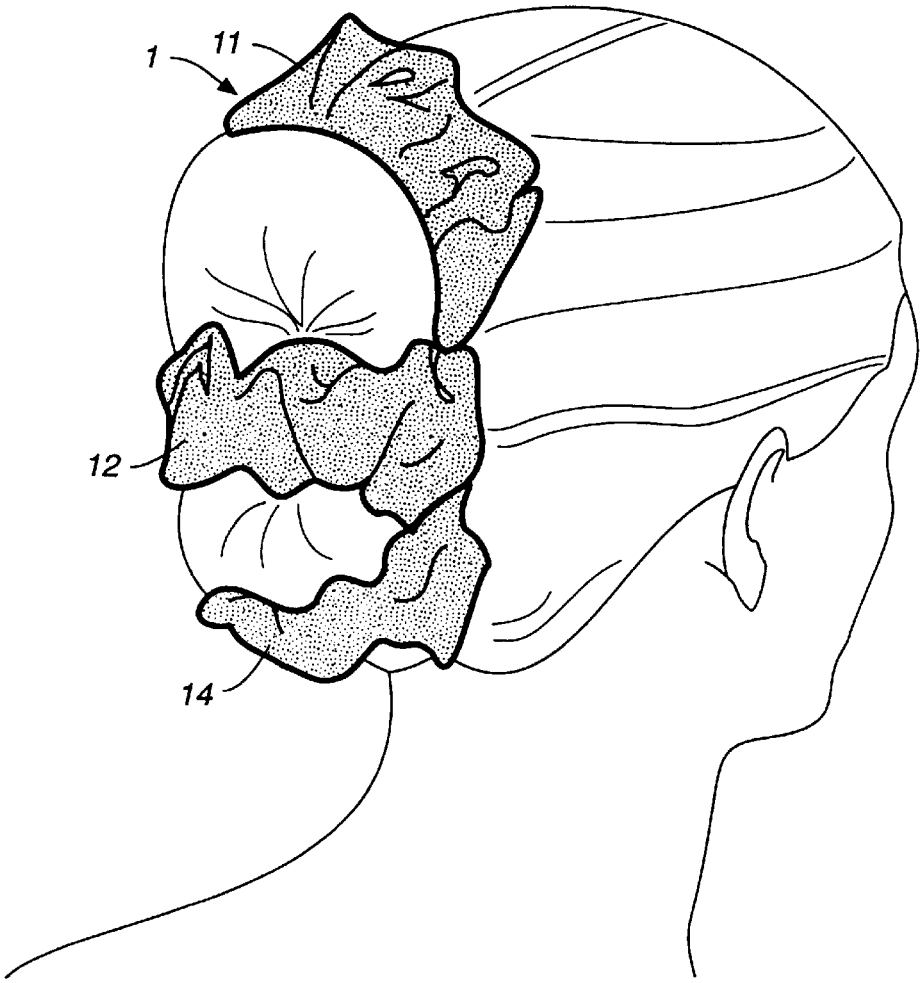
FIG. 1 is a perspective view of one embodiment of the hair accessory of this invention in use.

The present invention is a decorative hair accessory 1 which, in the embodiments of FIGS. 1–7 includes a decorative member 11 which has an elastic component 13 and two free ends 15, 17. The elastic component may be an elastic band or a width of elastic material and it may be connected to the decorative member proximate each of the free ends, as illustrated herein. The decorative member may be a tubular fabric member, as illustrated in FIGS. 1–7, or it may be a ribbon, a flattened piece of material, a close-fitting sleeve on the elastic band or one or more strands of beads. In the case of some decorative members, such as ribbons (not illustrated herein), the elastic component may be attached to the decorative member along a substantial portion of its length, causing a bunching of the decorative member. In other cases where the decorative member consists of beads or other decorative objects, the elastic component may be woven through the beads to cause them to constrict. In a preferred embodiment, the elastic band will have sufficient elasticity to allow it to be stretched to more than twice its length in a relaxed state. Of course, actual specifications will be selected to create a desired effect. The decorative member 11 may be a tubular fabric member with elastic component 13 disposed longitudinally therethrough, as illustrated in FIGS. 2–5. The tubular member may be constructed from a rectangular piece of material selected from a range of colors and fabrics. The material is sewn to form a tube with a preselected diameter and a longitudinal seam 19. In this embodiment, a length of an elastic band of the desired elasticity is inserted into the resulting tube with the finished side of the fabric out and the seam on the under surface 11*a* of the decorative member. The length of the decorative member can be selected based on the desired circumference of the continuous band for the embodiment shown in FIG. 7 or based on the length of the decorative band connecting the combs for the embodiment shown in FIGS. 2, 3, 5 and 6. The length may also vary depending on the elasticity of the elastic component 13. To create the "puffy" or "bunched" effect illustrated in FIGS. 2 and 3, for example, the preferred width of the tubular member is approximately 2 inches (5.08 cm.) (in finished state) and the preferred length of the decorative member from end 15 to end 17 is 8½ to 9 inches (21.59 to 22.86 cm.) when the decorative member is fully extended. It has been found that this length of the decorative member will provide a preferred amount of tension on the combs for the embodiment of FIG. 3 for typical use. For a tighter or looser fit of the resulting device, the bands can be shortened or lengthened, respectively. Obviously, different combinations of materials and elastic components may be constructed within the scope of this invention to provide different decorative members useful for different designs.

Figure 2:
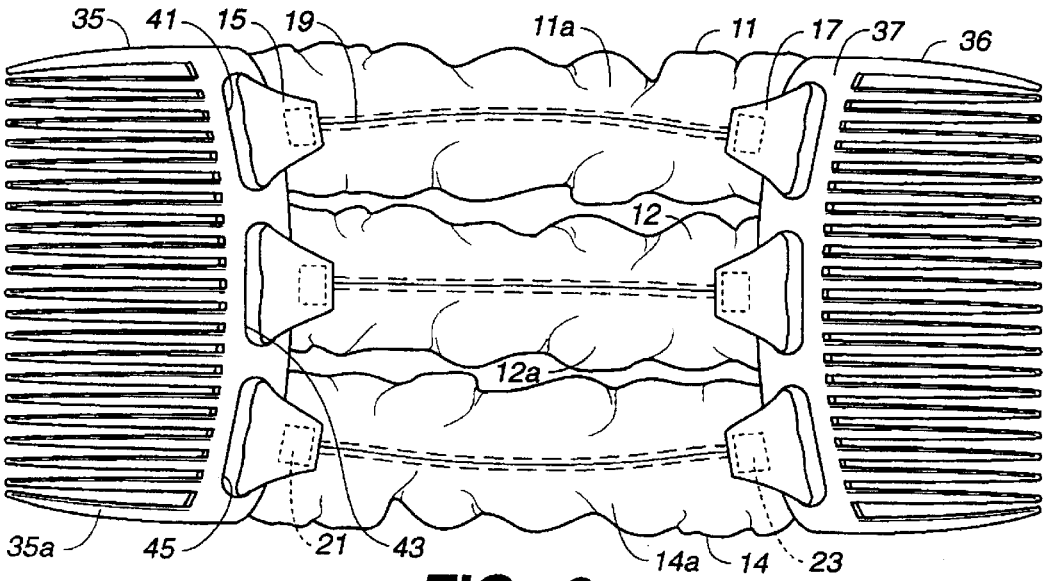
FIG. 2 is a bottom plan view of the embodiment shown in FIG. 1.
Figure 4:
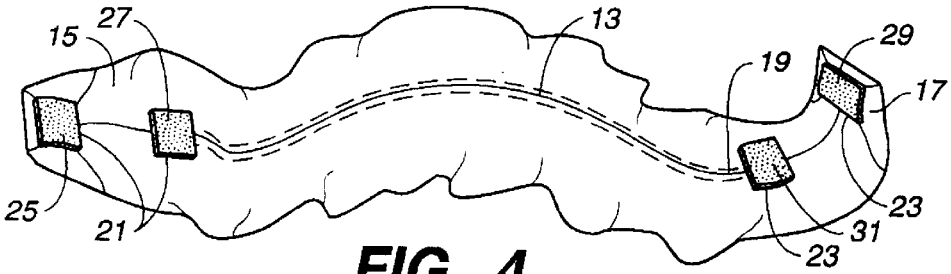
FIG. 4 is a bottom plan view of another embodiment of the invention.
Figure 5:
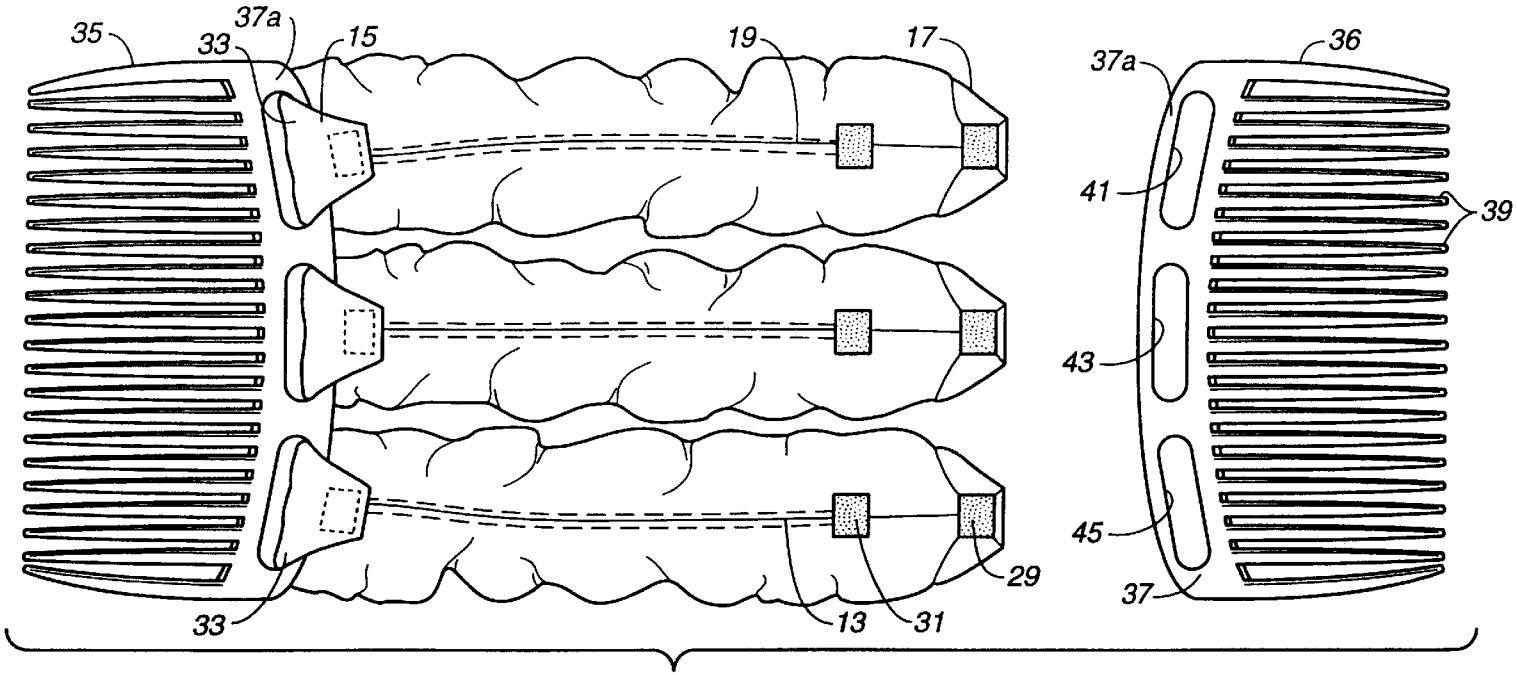
FIG. 5 is an exploded bottom plan view of the assembly of the embodiment of this invention shown in FIG. 2.

The free ends 15, 17 of the decorative member 11 may be finished in rectangular ends or in any desirable manner. Where the tubular member is relatively wide, the ends may be flattened for a predetermined distance and tapered, as illustrated in FIGS. 2, 4 and 5, to ease the insertion of the decorative members into the combs 35, 36 shown therein.

The decorative member 11 of these embodiments of the hair accessory of this invention has an attachment mechanism 21, 23 disposed proximate each of its free ends 15, 17. The attachment mechanism of one free end is removably attachable to the attachment mechanism proximate the other free end so that a continuous decorative elastic band, such as that shown in FIG. 7, could be formed when the attachment mechanisms are secured to each other. In the preferred embodiment, the free ends of the decorative member and the attachment mechanisms disposed therein are shaped to fit through an elongated opening 41 in the spine of a comb 35 or 36 so that the decorative member can be used as either the embodiment of FIG. 2 or FIG. 7. The attachment mechanism of the first free end preferably comprises first and second attachment members 25, 27, with the first attachment member disposed to mate with and removably secure itself to the second attachment member.

The first attachment member 25 is disposed near the end 15 of the decorative member 11 and the second attachment member 27 is disposed inwardly therefrom a sufficient distance to form a loop 33 when the first attachment member is attached to the second. The second attachment member is preferably spaced inwardly from the first attachment member a sufficient distance to allow a portion 37*a* of the spine 37 of the comb 35 to fit within the loop 33.

In the preferred embodiment, the attachment mechanism preferred for self-attachment is a two-component hook and loop fastening system, such as VELCRO® fasteners or an equivalent system of self-attaching tabs, in which one attachment member 25 is a first self-attaching tab or the first component of the two-component hook and loop fastening system and the second attachment member 27 is a second self-attaching tab or the second component of the fastening system. The preferred fastening system is a relatively flat attachment system which allows insertion of the free ends into the elongated openings in the comb, yet also provides for secure attachment. Other attachment systems may be used, however, such as snap fasteners and hook-and-eye fasteners, if they are sufficiently flat to fit through the openings 41, 43, 45 in the comb. It is understood that other attachment mechanisms which allow reattachment and meet the criteria of insertion into the holes of the comb can be used within the spirit of the invention.

Figure 7:
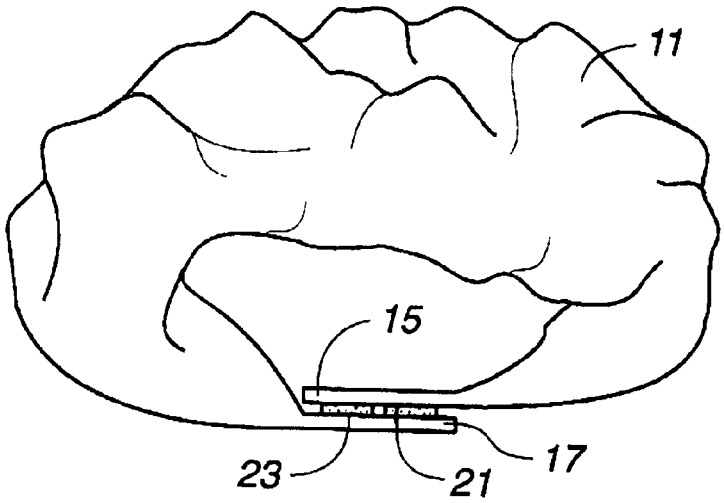
FIG. 7 is a side perspective view of the embodiment of FIG. 4.

The second free end 17 of the decorative member 11 also has a similar attachment mechanism which includes a first attachment member 29 and a second attachment member 31, which allows the free end to be folded back and form a loop on each end, or to mate with the first and second attachment members 25, 27 of the first free end 15 to form a continuous band, as shown in FIG. 7. The sizing and shape of the attachment members are not critical so long as the first attachment member will fit through the hole of the comb and there is sufficient spacing between the attachment members to allow the free end to fold back for the attachment of the first and second attachment members to each other and to allow some movement of the spine 37*a* of the comb 35 within the loop 33.

Figure 9:
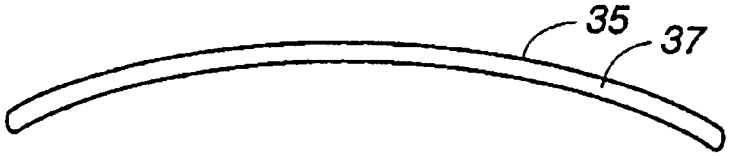
FIG. 9 is a rear elevational view of a comb of this invention.

Another embodiment of this invention is a comb 35 having an arcuate shape to conform to the user's head, as illustrated in FIG. 9. The comb has a relatively wide spine 37 and a series of teeth 39, 39 extending from the spine in regular alignment. The spine also has at least one elongated opening 41, and preferably two or three such openings, disposed longitudinally along said spine. Preferably the elongated openings in the comb of this embodiment, 41, 43 and/or 45, are sized to receive a removable elastic decorative member, such as those described above. However, other decorative items such as ribbons or flowers could be threaded through said openings.

The comb 35 of this embodiment may have a number of elongated openings 41, 43, 45, as desired. For use with the decorative members 11, 12, 14 of FIGS. 2–6, the openings in the comb are disposed at regular intervals along the length of the spine, so that the decorative members, when inserted in the openings, will cover most of the spine. It is understood that combs with a single opening and one decorative member or combs with two openings, such as that shown in FIG. 8, used with two decorative members are within the scope of this invention. The spine of the comb is relatively wide to provide structural support for the decorative members inserted through the elongated openings, for example, ½–¾ inches (1.27 to 1.9 cm.). The elongated openings may be 1–1½ inches (2.54 to 3.81 cm.) long to accommodate the preferred width (2 inches or 5.08 cm.) of the decorative members. The preferred length of the middle teeth 39, 39 from the outer spine of the comb is approximately 2½ inches (6.35 cm.), but the selection of these parameters is highly dependent on the ultimate effect desired and they can obviously be adjusted for different size combs and different lengths and elasticity of the decorative members.

Figure 8:
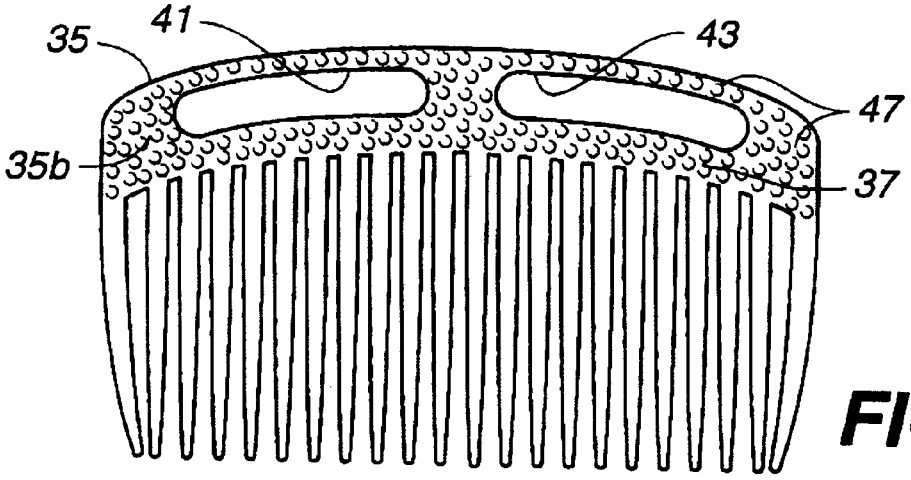
FIG. 8 is a bottom plan view of another embodiment of the invention.

In a preferred embodiment of this invention, the combs 35, 36 include indicator means 47 on one surface of the spine 37 to assist the user in assembling the comb with the decorative members 11. The indicator means may be visual or tactile and it may be disposed on the top surface 35*a* or the undersurface 35*b* of the comb 35 proximate the spine, as shown in FIG. 8 or it may be disposed on the top surface 36*a* or undersurface 36*b* of comb 36. The comb is preferably molded out of strong, flexible, high impact polycarbonate resin in a shape which is arcuate along its longitudinal axis, as can be seen in FIG. 9 so that the comb will conform to the user's head and be more comfortable and secure during wear.

These embodiments of this invention may be joined in a variety of combinations according to the desires of the user. The elastic decorative member 11 may be formed into a continuous ponytail holder such as shown in FIG. 7. The comb 35 may be decorated by inserting ribbons or the like in the elongated openings 41, 43, 45. In addition, one or more decorative elastic members 11, 12, 14 may be removably connected in a variety of alignments, fabrics, colors and decorative construction, to a pair of combs 35, 36, said combs having one, two or three elongated openings 41, 43, 45, to create unique accessories which express the creativity of the user.

Such a unique hair accessory may be constructed by providing a pair of detached combs 35, 36, each of the combs having a spine 37, a series of teeth 39, 39 extending from the spine, and one or more elongated openings 41, 43 and/or 45 disposed longitudinally in the spine. One or more elastic decorative members 11, 12, 14, each of which have two free ends 15, 16 with an attachment mechanism 21, 23 disposed on each end are removably attached to said combs. The first free end 15 of the decorative member 11 is inserted into elongated opening 41 in the spine of one of said combs 35 for a predetermined distance from the end. Generally, the end will be inserted until the first attachment member 25 has passed through the opening and the outer portion 37*a* of the spine is disposed between the first and second attachment members 25, 27 on the first free end 15. The decorative member 11 will be inserted through the opening from the under surface 35*a* of the spine, which may have indicator means 47 disposed for tactile recognition by the user. The under surface 11*a* of the elastic decorative member, which is the surface bearing the attachment members 25, 27 and the seam 19, is inserted through this opening so that in the first step of assembly the upper surface 35*a* of the comb 35 and the under surface 11*a* of the decorative member 11 are on the same side, as can be seen in FIGS. 2 and 5.

Figure 6:
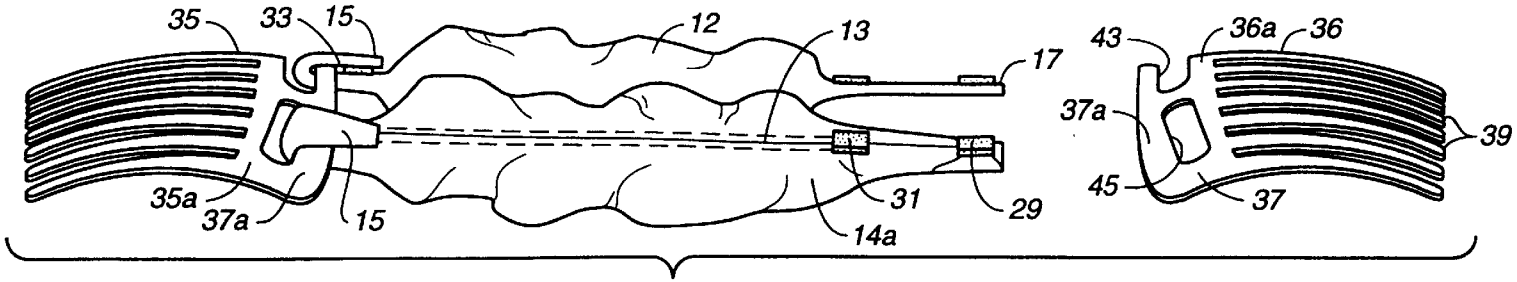
FIG. 6 is an exploded side elevational view of the embodiment shown in FIG. 5.

The first free end 15 of the decorative member 11 is then folded toward the decorative member with a portion of the spine 37*a* disposed in the folded portion of the decorative member, as can be seen in FIG. 6, wherein the first free end 15 is shown folded over to form loop 33. An outer portion of the first free end is attached to an inner portion of that free end, forming a closed loop 33 with a portion of the spine 37*a* of the first comb 35 secured in the loop. When the outer portion is folded over the spine of the comb, the first attachment member 25 (or 29) contacts and becomes attached to the second attachment member 27 (or 31), forming a secure, but removable, connection between the spine of the comb and that free end of the decorative member. The second free end 17 of the decorative member 11 is inserted similarly into elongated opening 41 in the spine of the other comb 36 and is folded back toward said decorative member with a portion 37*a* of the spine of the other comb disposed in the folded portion of that decorative member. The outer portion of the second free end, with a first attachment member 29 is made to contact the inner portion of the free end with the second attachment member 31, so that a closed loop 33 is also formed on the second free end.

The free ends 15, 17 of a second decorative member 12 may be similarly inserted into second elongated openings 43, 43 of the first and second comb 35, 36, if the combs have two openings, such as that shown in FIG. 8. If the combs have a third elongated opening, as illustrated in FIG. 5, the free ends of a third decorative member 14 could be inserted into elongated openings 45, 45. For an additional variation, the first free end 15 of decorative member 11 could be inserted into the third elongated opening 45 of the first comb 35 and the second free end 17 could be connected to the first opening 41 of the second comb 36. Other decorative members could be inserted into the remaining openings and twisted together before attachment to the spine of the second comb. In fact, for another variation, the first free end 15 of a decorative member 11 could be attached to the spine 37 of a first comb 35 at opening 41 and the second free end 17 of that same decorative member could be inserted into opening 43 (or 45) of the same comb 35. Then, a second decorative member 12 could be attached at one end 15 to opening 41 of comb 36 and then its other end 17 could be inserted through the loop formed by the first decorative member 11 and the first comb 35 and that end could be attached to the second comb 36 at a second opening 43 (or 45), so that the two combs could be connected by the connection of the decorative members to each other, rather than the attachment of each decorative member to both combs.

Figure 3:
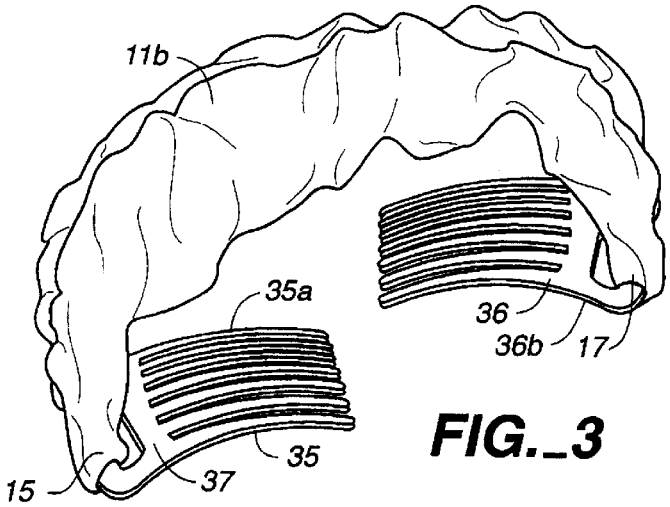
FIG. 3 is a side perspective view of the embodiment of FIG. 2.

In most instances, the accessory will be assembled in a desired decorative manner so that the undersides of the decorative members 11*a*, 12*a*, 14*a* are facing the same direction as the upper surface 35*a* and 36*a* of the combs. To use this hair accessory in the hair, one must ultimately turn the combs under the decorative member, as seen in FIG. 3, so that the teeth 39, 39 of the combs face each other in the hair and the upper surface 11*b* of the decorative members is visible in the hair. (For a relatively tight grip in the hair, it is preferable that the bands be short enough and the teeth of the comb long enough so that the teeth of the two combs would be separated by 1 to 1½ inches when turned toward each other in a relaxed state.) This arrangement in the hair may be accomplished by aligning the first comb with the teeth facing the user and the decorative members disposed away from the hair. For example, comb 35 in FIG. 2 would be flipped to the left and toward the middle of the underside of the decorative members and the device would be turned over. The teeth 39 of the first comb are slid into the hair so that the arcuate shape of the comb conforms to the user's head. The elastic members are pulled away from the first comb to the other side of a selection of hair. The second comb is aligned on the underside of the decorative members and with its teeth facing the hair and the teeth of the second comb are slid into the hair, with the decorative elastic members visible in the hair and pulling the combs toward each other to secure the accessory in the hair.

Thus, this invention provides a great deal of versatility and flexibility from the use of the several different components and embodiments of this invention. One may select a decorative elastic member which can be used as a ponytail holder on one occasion and which, on another occasion, can be used in combination with a similar or a contrasting colored decorative member to connect a pair of combs, which may be two-holed or three-holed, to create a unique and unusual arrangement in the hair. This decorative arrangement will also be very effective at securing and holding the hair in place. The decorative comb can be used on other occasions with different decorative items. The assembly of a variety of decorative bands and several pairs of combs will provide a great number of different accessories for use in creating different fashion effects. Thus, this invention solves a need for versatility of hair accessories and it provides the elements and the method for assembling a hair accessory which can be very effective and secure in the hair and which can be disassembled and used in connection with different arrangements on other occasions. Thus, it can be seen that the present invention will achieve the advantages and objects attributed to it and while it has been described in detail, it is not to be limited to such detail except as may be necessitated by the appended claims.

I claim:

1. A decorative hair accessory comprising a decorative member with two free ends, an elastic component connected to said decorative member proximate each of said free ends, a tubular member surrounding said elastic component and an attachment mechanism disposed proximate each of the free ends of said decorative member, said attachment mechanism proximate one free end being removably attachable to the attachment mechanism proximate said other free end, whereby a continuous decorative elastic band may be formed when said attachment mechanisms are secured to each other.

2. A decorative hair accessory comprising a decorative member having an elastic component and two free ends and an attachment mechanism disposed proximate one of said free ends, said attachment mechanism comprising first and second attachment members, said first attachment member being disposed to mate with and removably secure itself to said second attachment member.

3. The decorative hair accessory of claim 2 wherein one of said attachment members is a first component of a two component hook and loop fastening system and the other attachment member is a second component of the hook and loop fastening system.

4. The decorative hair accessory of claim 2 wherein said first and second attachment members of one free end of said decorative member may be attached to mating attachment members disposed proximate said other free end to form a continuous decorative band.

5. The decorative hair accessory of claim 2 wherein said second attachment member is disposed on said decorative member inwardly from said first attachment member a sufficient distance to form a loop at the free end of said decorative member when said first attachment member is attached to said second attachment member.

6. The decorative hair accessory of claim 5 wherein said first attachment member of said free end of said decorative member is sized to fit through an opening disposed in a spine of a hair comb and to attach to said second attachment member with a portion of said spine secured within the loop formed by said attachment members.

7. The decorative hair accessory of claim 5 wherein said elastic component is an elastic member connected to said decorative member proximate each of said free ends.

8. The decorative hair accessory of claim 7 wherein said decorative member further comprises a tubular member surrounding said elastic member, said tubular member having at least one free end flattened for a predetermined distance.

9. The decorative hair accessory of claim 2 further comprising an attachment mechanism disposed on the other of said free ends of the decorative member and a pair of detached combs, each of said combs having a spine and a series of teeth extending therefrom along one side of said spine, each of said combs having at least one opening disposed in said spine, each free end of said decorative member being removably attachable to the spine of one of said pair of combs proximate an opening in said spine.

10. The decorative hair accessory of claim 9 wherein one free end of said decorative member may be inserted into an opening in the spine of one of said combs for a predetermined distance from said free end and said first attachment member may be secured to said second attachment member to form a loop around a portion of said spine and to secure a portion of said spine between said first and second attachment members.

11. The decorative hair accessory of claim 10 wherein the other free end of said decorative member may be attached to the other of said pair of combs proximate an opening in the spine of said other comb and the elastic component is adapted to pull said combs toward each other when said combs are disposed more than a predetermined distance apart.

12. The decorative hair accessory of claim 10 wherein said combs are arcuate and have a plurality of elongated openings disposed longitudinally in said spine.

13. The decorative hair accessory of claim 12 wherein each of said combs comprises indicator means disposed on one surface of said spine to align the comb relative to the decorative member.

14. A decorative hair accessory comprising a comb having an arcuate shape along its length to conform to a user's head, said comb having a spine and a series of teeth extending therefrom along one side of said spine, said spine having at least one opening disposed transversely through said spine and at least one removable decorative member having an elastic component and two free ends and an attachment mechanism disposed on each of said free ends, said attachment mechanism permitting removable attachment of a free end to the spine of said comb proximate said opening.

15. The decorative hair accessory of claim 14 wherein one of said free ends of the decorative member has first and second attachment members whereby said free end may be inserted through the opening of said spine and folded inwardly to form a loop around and capture a portion of the spine of the comb when said first attachment member is attached to said second attachment member.

16. The decorative hair accessory of claim 15 wherein the other of said free ends of the removable decorative member is removably attached to a second comb through an opening in a spine of said second comb and said elastic component pulls said first and second combs toward each other.

17. The decorative hair accessory of claim 14 further comprising a second comb and each free end of said decorative member being removably attachable to the spine of one of said combs proximate an opening in said spine.

18. The decorative hair accessory of claim 17 further comprising a plurality of decorative members and a plurality of regularly spaced openings in each of said combs.

19. A method for providing a decorative hair accessory, comprising the steps of:

(a) providing a pair of detached combs, each of said combs having a spine and a series of teeth extending therefrom along one side of said spine, each of said combs further comprising an elongated opening disposed longitudinally in said spine;

(b) providing an elastic decorative member having two free ends with an attachment mechanism disposed proximate each of said free ends;

(c) inserting a first free end of said elastic decorative member into an elongated opening in the spine of one of said combs for a predetermined distance from said free end;

(d) folding said free end toward said decorative member with a portion of the spine of said one comb disposed in said folded portion of said decorative member;

(e) attaching an outer portion of said first free end to an inner portion of said first free end, forming a closed loop with a portion of said spine of said one comb secured in said loop;

(f) inserting a second free end of said elastic decorative member into an elongated opening in the spine of the other of said combs;

(g) folding said second free end toward said decorative member with a portion of the spine of said other comb disposed in said folded portion of said decorative member;

(h) attaching an outer portion of said second free end to an inner portion thereof, forming a closed loop with a portion of said spine of said other comb secured in said loop.

20. The method of claim 19 wherein each of said combs has a plurality of elongated openings disposed in its spine and a plurality of elastic decorative members are provided, the method further comprising (a) selecting a first free end of a first elastic decorative member and connecting it to one of said elongated openings in a first comb, (b) connecting a second free end of said first elastic decorative member to one of said elongated openings in a second comb; and (c) repeating steps (a) and (b) for each additional elastic decorative member.

21. The method of claim 20 wherein each of said combs has an arcuate shape to conform to a user's head and said method further comprises:

(a) aligning the first comb with the teeth facing the user and the decorative members disposed away from the hair;

(b) sliding the teeth of said first comb into the hair so that the arcuate shape conforms to the user's head;

(c) extending the decorative elastic members away from the first comb;

(d) aligning said second comb with the teeth facing the hair of the user;

(e) sliding the teeth of said second comb into the hair toward said first comb whereby said decorative elastic members will pull said combs toward each other to secure said accessory in the hair.

22. The method of claim 21 wherein indicator means are disposed on an under surface of said combs and the free ends of said decorative elastic bands are inserted through the elongated openings in the spine of said combs from said under surface.

23. A method for providing a decorative hair accessory, comprising the steps of:

(a) providing a comb having a spine and a series of teeth extending therefrom along one side of said spine, said comb further comprising an elongated opening disposed longitudinally in said spine;

(b) providing a removable elastic decorative member having two free ends with an attachment mechanism disposed proximate each of said free ends;

(c) inserting a first free end of said elastic decorative member into an elongated opening in the spine of said comb for a predetermined distance from said free end;

(d) folding said free end toward said decorative member with a portion of the spine of said comb disposed in said folded portion of said decorative member;

(e) attaching an outer portion of said first free end to an inner portion of said first free end, forming a closed loop with a portion of said spine of said comb secured in said loop;

(f) inserting a second free end of said elastic decorative member into a second elongated opening in the spine of said comb;

(g) folding said second free end toward said decorative member with a portion of the spine of said comb proximate said second elongated opening disposed in said folded portion of said decorative member;

(h) attaching an outer portion of said second free end to an inner portion thereof, forming a closed loop with a portion of said spine of said comb proximate said second elongated opening secured in said loop.

24. A decorative hair accessory comprising at least one decorative member, said decorative member having an elastic component and two free ends and an attachment mechanism disposed on each of said free ends, a pair of detached combs, each of said combs having a spine, a series of teeth extending from said spine along one side and at least one opening disposed in said spine, and each free end of said decorative member is removably attachable to the spine of one of said pair of combs proximate an opening in said spine.

25. A decorative hair accessory comprising a pair of combs, each of said combs having an arcuate shape along its length, a spine and a series of teeth extending from said spine along one side, said pair of combs connected by at least two decorative members, each of said decorative members having an elastic component and two free ends and an attachment mechanism proximate each free end for releasable attachment to the spine of one of said combs.

26. The decorative hair accessory of claim 25 wherein the spine of each of said combs comprises a plurality of spaced openings for removable attachment of a decorative member.

27. A decorative hair accessory comprising at least one comb having an arcuate shape along its length, said comb having a spine and a series of teeth extending therefrom along one side of said spine, said spine having at least one opening and at least one removable decorative member having two free ends and an elastic component, and an attachment mechanism proximate a first free end, said attachment mechanism permitting removable attachment of said first free end to the spine of said comb proximate said opening.

28. The decorative hair accessory of claim 27 wherein said removable decorative member comprises an attachment mechanism proximate each of said free ends.

29. The decorative hair accessory of claim 28 wherein one of said free ends of the decorative member has first and second attachment members and when said free end is inserted through the opening in said spine and said first attachment member is attached to said second attachment member a loop is formed to capture a portion of the spine of the comb.

30. The decorative hair accessory of claim 29 wherein the other of said free ends of the decorative member is removably attached to a second comb through an opening in a spine of said second comb and said elastic component pulls said first and second combs toward each other.

31. The decorative hair accessory of claim 30 further comprising a plurality of decorative members and a plurality of regularly spaced openings in each of said combs.

* * * * *